US009731309B2

(12) United States Patent
Yamada et al.

(10) Patent No.: US 9,731,309 B2
(45) Date of Patent: Aug. 15, 2017

(54) FOAM DISPENSING CAP

(71) Applicant: NIPPON CLOSURES CO., LTD., Tokyo (JP)

(72) Inventors: Motokatsu Yamada, Kanagawa (JP); Tomoya Igarashi, Kanagawa (JP); Takahiro Akaogi, Kanagawa (JP); Ken Hirosawa, Aichi (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 28 days.

(21) Appl. No.: 14/760,583

(22) PCT Filed: Jan. 23, 2014

(86) PCT No.: PCT/JP2014/051393
§ 371 (c)(1),
(2) Date: Jul. 13, 2015

(87) PCT Pub. No.: WO2014/119465
PCT Pub. Date: Aug. 7, 2014

(65) Prior Publication Data

US 2015/0352572 A1 Dec. 10, 2015

(30) Foreign Application Priority Data

Jan. 31, 2013 (JP) ..... 2013-017334

(51) Int. Cl.
*B05B 11/04* (2006.01)
*B05B 7/00* (2006.01)
(Continued)

(52) U.S. Cl.
CPC ..... *B05B 11/047* (2013.01); *B05B 7/0018* (2013.01); *B05B 7/0062* (2013.01);
(Continued)

(58) Field of Classification Search
CPC ..... A47K 5/1201; A47K 5/14; B05B 11/04; B05B 11/047; B05B 7/0018;
(Continued)

(56) References Cited

U.S. PATENT DOCUMENTS 5,156,307 A * 10/1992 Callahan ..... B05B 7/0037 222/190
5,984,146 A * 11/1999 Kaufman ..... A47K 5/122 222/190
(Continued)

FOREIGN PATENT DOCUMENTS

CA 2073256 1/1999
CN 1347834 5/2002
(Continued)

OTHER PUBLICATIONS

International Search Report issued in PCT/JP2014/051393, dated Apr. 22, 2014.
(Continued)

*Primary Examiner* — Frederick C Nicolas
*Assistant Examiner* — Bob Zadeh
(74) *Attorney, Agent, or Firm* — Greenblum & Bernstein, P.L.C.

(57) ABSTRACT

A foam dispensing cap includes a cap body having a ceiling wall and a cylindrical side wall, and a partition member. An ejection pipe is erected on the upper surface of the ceiling wall. An air chamber is in the space below the ceiling wall. A liquid entry opening is in the partition member. In the air chamber, an air passage for flowing air within the air chamber and a liquid flow path for flowing the content liquid, which has passed through the partition wall and entered the air chamber, communicate with each other. The air passage and the liquid flow path are formed to merge, and a region ranging from the point of merging to the ejection
(Continued)

pipe defines an air-liquid mixture flow path. When the squeeze container is tilted and squeezed, the content liquid is ejected in a foamy state from the leading end of the ejection pipe.

6 Claims, 9 Drawing Sheets

(51) Int. Cl.

| | |
|---|---|
| ***B65D 1/32*** | (2006.01) |
| ***B65D 47/08*** | (2006.01) |
| ***B65D 47/10*** | (2006.01) |
| ***B65D 51/20*** | (2006.01) |
| *A47K 5/12* | (2006.01) |
| *A47K 5/14* | (2006.01) |

(52) U.S. Cl.
CPC ..... *B05B 11/04* (2013.01); *B65D 1/32* (2013.01); *B65D 47/0833* (2013.01); *B65D 47/0838* (2013.01); *B65D 47/103* (2013.01); *B65D 51/20* (2013.01); *A47K 5/1201* (2013.01); *A47K 5/14* (2013.01); *B65D 2251/0025* (2013.01); *B65D 2251/0056* (2013.01); *B65D 2251/0087* (2013.01)

(58) Field of Classification Search
CPC ..... B05B 7/0062; B65D 1/32; B65D 2251/0056; B65D 2251/0087; B65D 47/0833; B65D 47/103; B65D 51/20; B65D 2251/0025
See application file for complete search history.

(56) References Cited

U.S. PATENT DOCUMENTS 8,727,244 B2 * 5/2014 Bernstein ..... A45F 3/16 222/215
2002/0070238 A1 6/2002 Pritchett et al.
2002/0130198 A1 * 9/2002 Bennett ..... B05B 7/0037 239/343
2010/0126523 A1 * 5/2010 Fujinuma ..... B05B 11/048 132/221
2011/0284587 A1 * 11/2011 Galazka ..... B05B 7/0037 424/70.1
2015/0352572 A1 * 12/2015 Yamada ..... B65D 1/32 222/190

FOREIGN PATENT DOCUMENTS

| | | |
|---|---|---|
| JP | 61-183159 | 11/1986 |
| JP | 3-23063 | 3/1991 |
| JP | 5-2585 | 1/1993 |
| JP | 2502508 Y | 6/1996 |
| JP | 9-142510 | 6/1997 |
| JP | 10-35706 | 2/1998 |
| JP | 10-81895 | 3/1998 |
| JP | 11-124160 | 5/1999 |
| JP | 2005-75357 | 3/2005 |
| JP | 2008-259932 | 10/2008 |
| JP | 2009-286468 | 12/2009 |
| JP | 2010-241449 | 10/2010 |

OTHER PUBLICATIONS

Extended European Search Report issued in Patent Application No. 14745593.5, dated Sep. 1, 2016.

Chinese Office Action issued in Patent Application No. 201480006401.6, dated Jul. 28, 2016.

* cited by examiner

FOAM DISPENSING CAP

TECHNICAL FIELD

This invention relates to a foam dispensing cap. More specifically, the invention relates to a foam dispensing cap which is mounted on a squeeze container and in which when the container is tilted and squeezed, a content liquid is ejected in a foamy state from a content liquid ejection pipe provided in the cap.

BACKGROUND ART

Caps equipped with a mechanism for ejecting a content liquid out of a container in a foamy state (i.e., foam dispensing caps) have so far been known. These caps are applied to containers, such as bottles, where seasonings, foods, beverages, cleaning agents, or cosmetics, for example, are accommodated.

With such a foam dispensing cap, the content liquid has to be mixed with air, and then ejected from the container. Thus, the publicly known foam dispensing cap is provided with a tube not for discharging air inside the container (air present in a head space) immediately out of the container in ejecting the content liquid, but for once taking in this air and mixing it with the content liquid, or a tube for discharging the content liquid in such a manner as to be mixable with the air inside the container. Such a tube is very long (see, for example, Patent Documents 1 and 2).

The foam dispensing cap provided with the above-mentioned tube, however, poses the problem that a capping operation for mounting this cap on the mouth of the container is extremely troublesome. That is, such a tube is not only long, but is also highly flexible, thus making it very troublesome to perform, for example, alignment for passing the tube through the container mouth having a small diameter.

A foam dispensing cap without such a tube has also been proposed (see Patent Document 3).

Such a foam dispensing cap is mounted with a small bubble generation sheet of a Teflon (registered trademark)-coated cloth or the like, and the container content liquid and air present in the head space of the bottle are discharged through the sheet to eject the content liquid in a foamy state.

The cap of Patent Document 3 mentioned above is not mounted with a particular tube. Thus, a capping operation for mounting the cap on the mouth of the container is very easy, but involves the problem of a noticeably low foam dispensing function. That is, air necessary for generation of air bubbles is discharged very quickly when the container is tilted and squeezed. As a result, a tiny amount of the content liquid ejected initially is the only foam dispensed.

PRIOR ART DOCUMENTS

Patent Documents

Patent Document 1: JP-UM-A-61-183159

Patent Document 2: JP-B-5-2585

Patent Document 3: JP-A-11-124160

SUMMARY OF THE INVENTION

Problems to be Solved by the Invention

It is an object of the present invention, therefore, to provide a foam dispensing cap free of a member inhibiting capping, such as a tube, and capable of performing foam dispensing persistently.

Means for Solving the Problems

According to the present invention, there is provided a foam dispensing cap to be mounted on a mouth of a squeeze container, the foam dispensing cap comprising a cap body composed of a ceiling wall and a cylindrical side wall suspending downwardly from a circumferential edge of the ceiling wall; and a partition member having an opening serving as a passage for a content liquid charged in the squeeze container, the partition member being mounted in the cap body, wherein an ejection pipe communicating with a space below the ceiling wall and adapted to eject the content liquid in the container is erected on an upper surface of the ceiling wall;

an air chamber is formed in the space below the ceiling wall, the air chamber being partitioned off from a head space of the squeeze container by the partition member when the foam dispensing cap is mounted on the mouth of the squeeze container;

in the air chamber, an air passage for flowing air within the air chamber to the ejection pipe and a liquid flow path for flowing the content liquid, which has passed through the opening and entered the air chamber, to the ejection pipe communicate with each other, the air passage and the liquid flow path are formed to merge at a confluence, and a region ranging from the confluence to the ejection pipe defines an air-liquid mixture flow path; and when the squeeze container is tilted and squeezed, the content liquid passes through the opening provided in the partition member, enters the air chamber, and flows into the liquid flow path and, at the same time, air within the air chamber flows into the air passage under a liquid pressure due to entry of the content liquid into the air chamber, whereupon the content liquid flowing into the liquid flow path and the air flowing into the air passage mingle with each other at the confluence, and the content liquid containing air bubbles passes through the ejection pipe and is ejected in a foamy state from a leading end of the ejection pipe.

In the foam dispensing cap of the present invention, it is preferred that at least one mesh member for adjusting an air bubble diameter be provided between the region, where the content liquid and the air mingle, and the leading end of the ejection pipe.

The foam dispensing cap of the present invention can also adopt (1) a mode in which a portion to be engaged with or fitted to the mouth of the squeeze container is formed in the cylindrical side wall, and a foaming box is fixed as the partition member to an interior of the cylindrical side wall, the foaming box having a partition wall, in whose peripheral edge portion the liquid entry opening for passage of the content liquid is formed, and an upright wall extending upward from an outer peripheral portion of the partition wall, and the foaming box being assembled such that the air chamber, the air passage and the liquid flow path are formed.

In the above mode, it is preferred that upon fixing of the foaming box to the interior of the cylindrical side wall, (1-1) the air-liquid mixture flow path communicating with the interior of the ejection pipe be formed between the lower surface of the ceiling wall and the upper surface of the box; or (1-2) the air-liquid mixture flow path be formed inside the foaming box.

Aside from the above-mentioned mode, the foam dispensing cap of the present invention can further adopt (2) a mode in which an inner lid having as an upper surface thereof a partition wall provided with an opening and being adapted to be fixed to the mouth of the squeeze container functions as the partition member; the cylindrical side wall is provided detachably on the inner lid; an opening-scheduled portion, which forms the opening upon rupture due to pulling of an unsealing ring, is formed in the partition wall of the inner lid; and the air chamber, the air passage, the liquid flow path, and the air-liquid mixture flow path are formed between the partition wall, which is the upper surface of the inner lid, and the ceiling wall.

Effects of the Invention

The important feature of the foam dispensing cap of the present invention lies in such a structure that between the ceiling wall constituting the cap and the head space of the container, the air chamber partitioned off from the head space is formed, air within the air chamber is mixed with the content liquid charged into the container, and the mixture is ejected outside. That is, the air present in the air chamber formed within the cap is used. Unlike a case where air present within the head space of the container is used, there is no need to use a tube for discharging air so as to be mixed with the content liquid. Nor is it necessary, needless to say, to use a tube for discharging the content liquid so as to be mixed with air. The air to be mixed with the content liquid is present within the air chamber, and not present in the head space within the container. Moreover, the content liquid in the container passes through the liquid flow path from the liquid entry opening formed in the peripheral edge portion of the partition wall, is mixed with air from the air chamber, and is ejected in a foamy state from the ejection pipe, without implementation of a particular measure.

In the present invention, therefore, a particular member such as a tube is not needed for foam dispensing. Consequently, the foam dispensing cap of the invention can easily perform a capping operation for the mouth of the container.

In the present invention, moreover, air present in the air chamber of the cap is discharged through the air passage under the liquid pressure exerted when the content liquid in the container enters the air chamber. The cap has such a structure that at this time, the liquid flow path for passage of the content liquid flowing out of the air chamber merges with the air passage. In other words, it is not that the content liquid flows through the same path as for air while pushing out the air. Hence, the disadvantage that when the content liquid reaches the confluence of the liquid flow path and the air passage where its mixing with air begins, most of air has already been discharged to the outside is effectively prevented. Instead, a certain amount of air can be persistently mixed with the content liquid, and the mixture can be persistently ejected in the state of a foam.

MODE FOR CARRYING OUT THE INVENTION

Figure 1:
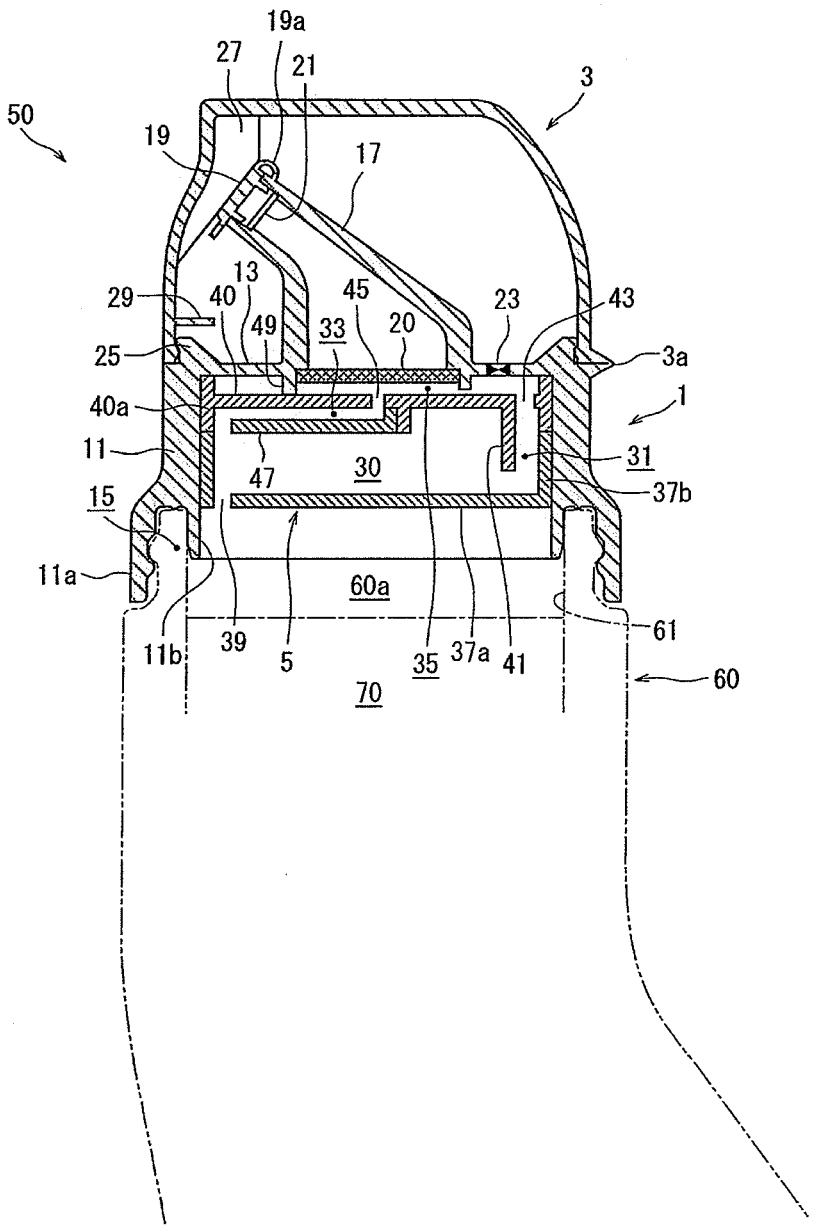
FIG. 1 is a side sectional view of a foam dispensing cap according to the present invention.

In FIG. 1, the foam dispensing cap of the present invention, indicated entirely at 50, is mounted on the mouth 61 of a bottle-shaped squeeze container 60.

First of all, the squeeze container 60 will be described. This container is generally molded in the shape of a bottle from a thermoplastic resin of any of various types. The container 60 is tilted and its barrel is squeezed, whereby a content liquid in the container is ejected as if to be squeezed out.

The thermoplastic resin for forming such a container 60 is not limited, as long as it can be molded into the shape of a container such as a bottle. Generally, however, it should have flexibility and suppleness required of a squeeze container. From this point of view, olefin resins or polyester resins such as polyethylene terephthalate are used. Examples of the olefin resins are polymers of various olefins, such as low density polyethylene, linear low density polyethylene, medium density polyethylene, high density polyethylene, and polypropylene; copolymers of various olefins, such as propylene-ethylene copolymer; ethylene-vinyl acetate copolymer; modified olefin copolymers such as olefin resins graft-modified with ethylenically unsaturated carboxylic acids or their anhydrides; and blends of any of them. The particularly preferred one is low density polyethylene.

The container may be formed of a plurality of layers, as long as its squeezability is ensured. For example, a gas barrier resin layer composed of ethylene-vinyl alcohol copolymer or the like may be formed, as appropriate, between an inner skin and an outer skin of olefin resin via an adhesive layer. Alternatively, the container may be structured to have a polyester resin layer, such as polyethylene terephthalate, laminated on an outer surface, which is an olefin resin layer, via an adhesive layer.

The above squeeze container 60 can be produced by a publicly known method and, for example, is produced by a so-called direct blow molding method which comprises extruding the above-mentioned thermoplastic resin into the shape of a pipe, pinching off the front end of the pipe to form a parison, and blowing compressed air into the parison to form it into a bottle.

The foam dispensing cap 50, roughly speaking, is composed of a cap body 1 fixed to the mouth 61 of the aforementioned container 60, an outer lid 3 hingedly connected to the cap body 1, and a foaming box 5 incorporated into the interior of the cap body 1.

These cap constituent members are all formed of various thermoplastic resins, especially, olefin resins, as is the container 60.

The cap body 1 is composed of a cylindrical side wall 11, and a ceiling wall 13 formed to close an upper end opening of the cylindrical side wall 11.

A lower part of the cylindrical side wall 11 branches into an outer side wall 11*a* outwardly increased in diameter, and an inner ring 11*b* located inwardly. The mouth 61 of the container 60 is inserted into an annular concavity 15 between the cylindrical side wall 11*a* and the inner ring 11*b*, whereby the cap 50 is fixed to the container 60. A fixing means employed for this fixing may be such means as fitting or threaded engagement. Whichever means is adopted, it is common practice to bring the inner ring 11*b* into intimate contact with the inner surface of the container mouth 61, thereby sealing up the interior of the container 60.

An ejection pipe 17 is erected on the upper surface of the ceiling wall 13, and the content liquid inside the container 60 is passed through the ejection pipe 17 and ejected from its leading end in a foamy state.

The ejection pipe 17 has an upper part inclining and, to its leading end an inner lid 19 is hinge-connected at a junction 19*a*.

The above-described ejection pipe 17 needs to communicate with the interior of the container. Thus, a portion of the ceiling wall 13 which is surrounded with the ejection pipe 17 (namely, the base of the ejection pipe 17) defines an opening.

Preferably, a mesh member for imparting fine air bubble diameters is provided within the ejection pipe 17. In the illustrated example, a coarse mesh 20 is mounted at the above opening (the base of the ejection pipe 17), while a fine mesh 21 is mounted inwardly of the leading end of the ejection pipe. Consequently, the content liquid is ejected in the state of a fine foam.

The ceiling wall 13 is also provided with a non-return valve 23 for taking in air necessary for forming the foam. The non-return valve is provided at a portion outward of the ejection pipe 17 and in a direction opposite to the side at which the leading end of the ejection pipe 17 is directed. The functions of the non-return valve will be described later.

Furthermore, a peripheral edge portion of the upper surface of the ceiling wall 13 is provided with an engagement projection 25 for holding the outer lid 3 hinge-connected to the cap body 1 in a closed state stably.

Inside the outer lid 3, on the other hand, there are provided a rib 27 for holding the hinge lid 19, which is provided at the leading end of the ejection pipe 17, in a closed state, and a protruding piece 29 for opening and closing the hinge lid 19 interlockingly with the opening and closing of the outer lid 3.

That is, the outer lid 3 is opened and closed when pivoted about a hinge connection 3*a* as a fulcrum. When the outer lid 3 is pivoted for closure, the protruding piece 29 and the rib 27 touch the hinge lid 19 during this pivoting and, while they are pushing the hinge lid 19, the outer lid 3 turns in a closing direction. When, as a result, the outer lid 3 is closed, the hinge lid 19 is also closed, whereby the leading end of the ejection pipe 17 is sealed.

Moreover, the closed outer lid 3 has the inner surface at the lower end of its side wall brought into engagement with the engagement projection 25 formed in the peripheral edge portion of the ceiling wall, with the result that the closed state of the outer lid 3 is held stably. Simultaneously, the rib 27 provided in the outer lid 3 is firmly pressed against the inner lid 19, so that the closed state of the inner lid 19 is also held stably.

When the closed outer lid 3 is pivoted to be opened, the protruding piece 29 provided in the outer lid 3 contacts a flange portion of the inner lid 19 to push the inner lid 19 upward in accordance with the pivoting of the outer lid 3. As a result, simultaneously with the unclosing of the outer lid 3, the inner lid 19 is also unclosed, whereupon the leading end of the ejection pipe 17 is opened to become capable of ejecting the content liquid.

In the present invention, the foaming box 5 provided within the cap body 1 functions as a partition member for forming an air chamber 30, and is assembled using panels of various shapes. As will be understood from FIG. 1, the foaming box 5 is fitted into the cylindrical side wall 11 of the cap body 1 and fixed there.

Figure 2:
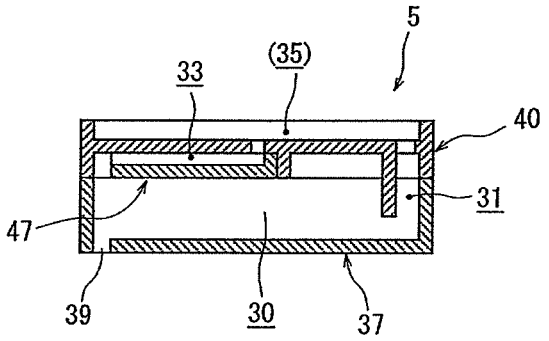
FIG. 2 is a view showing a foaming box provided in the foam dispensing cap of FIG. 2.
Figure 3:
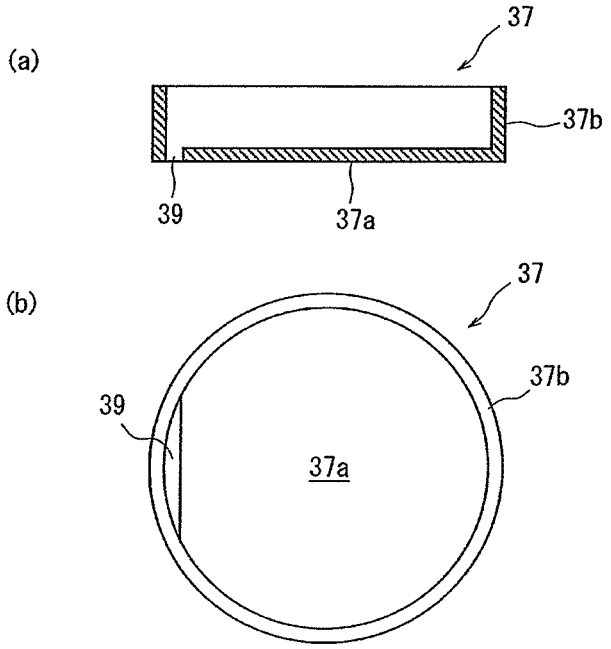
FIGS. 3(*a*), 3(*b*) are a side sectional view and a plan view, respectively, showing a partition member of the foaming box in FIG. 2.

Referring to FIG. 1, and together with it, FIG. 2 showing the foaming box 5 and FIGS. 3(*a*), 3(*b*) to 5(*a*), 5(*b*) showing the shapes of various panels for use in the assembly of the foaming box 5, the foaming box 5 has the air chamber 30. From the air chamber 30, an air passage 31 and a liquid flow path 33 extend, and the air passage 31 and the liquid flow path 33 merge at a location between the foaming box 5 and the ceiling wall 13 of the cap body 1, forming an air-liquid mixture flow path 35.

Figure 4:
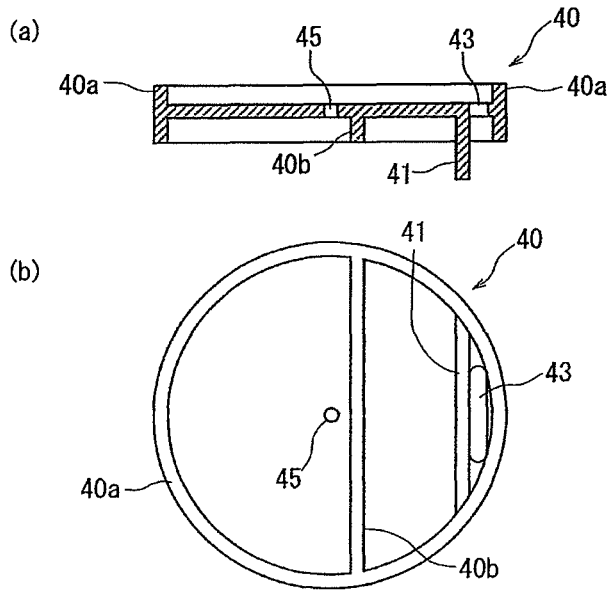
FIGS. 4(*a*), 4(*b*) are a side sectional view and a plan view, respectively, showing a top wall member of the foaming box in FIG. 2.
Figure 5:
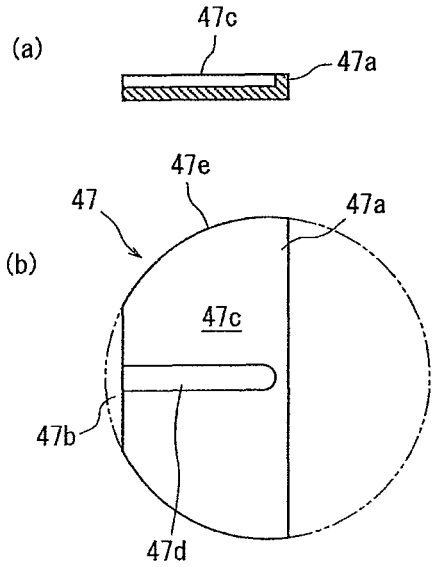
FIGS. 5(*a*), 5(*b*) are a side sectional view and a plan view, respectively, showing a liquid flow path formation member of the foaming box in FIG. 2.

The foaming box 5 mentioned above is formed from a partition plate 37 (see FIGS. 3(*a*), 3(*b*)), a top wall plate 40 (see FIGS. 4(*a*), 4(*b*)), and a liquid flow path formation plate 47 (see FIGS. 5(*a*), 5(*b*)).

The air chamber 30 is adapted to accommodate air necessary for foaming, and is divided from a head space 60*a* within the container 60 (i.e., a space within the container above the liquid surface of a content liquid 70 within the container) by a partition wall 37*a* serving as the bottom wall of the box 5.

As shown in FIGS. 3(*a*), 3(*b*), the partition plate 35 is formed from the disk-shaped partition wall 37*a*, and an upright wall 37*b* rising from its circumferential edge. In a peripheral edge portion of the partition wall 37*a*, moreover, a liquid entry opening 39 is formed for taking the content liquid of the container into the box 5.

Also referring to FIGS. 4(*a*), 4(*b*) the top wall plate 40 serving as the top wall of the foaming box 5 is shaped like a disk, and has a relatively short upright wall 40*a* extending upward and downward from the circumferential edge of the top wall plate 40. At a part of the top wall plate 40 near the end of the lower surface thereof, there is formed a downwardly extending air passage formation wall 41 for forming the air passage 31. The part surrounded by the air passage formation wall 41, the upright wall 40*a*, and the upright wall 37*b* defines the air passage 31, and an air port 43 is formed in an upper part of the air passage 31. Further, an opening 45 for passage of the content liquid is formed in the middle of the top wall plate 40.

Furthermore, a downward wall 40*b* for stably mounting the liquid flow path formation plate 47 thereto is formed on the lower surface of the top wall plate 40. The downward wall 40*b* is located slightly toward the side where the air passage formation wall 41 and the air port 43 are located. The top wall plate 40 is configured such that the opening 45 is located in a region where the air passage formation wall 41 and the air port 43 are not formed, with respect to the downward wall 40*b*.

By reference to FIGS. 5(*a*), 5(*b*), the liquid flow path formation plate 47 has a shape corresponding to one side of the downward wall 40*b* of the above-described top wall plate 40 (the side where the opening 45 exists) and, accordingly, has a shape similar to a semicircle in the illustrated example.

In this liquid flow path formation plate 47, a portion facing the downward wall 40*b* defines a flat side wall surface 47*a* extending linearly, and a side wall surface 47*e* extends arcuately from each end of the side wall surface 47*a*. On a side opposing the linear side wall surface 47*a*, a cutout 47*b* is formed for forming an opening through which the content liquid having entered the air chamber 30 is introduced into the liquid flow path 33. Thus, an upper surface wall 47*c* of the liquid flow path formation plate 47 has a nearly semicircular shape, and a groove 47*d* extends from the cutout 47*b* through a central part of the upper surface wall 47*c* (see FIG. 5(*b*)). When the liquid flow path formation plate 47 is mounted to the top wall plate 40, the groove 47*d* communicates with the opening 45 of the top wall plate 40.

That is, such a liquid flow path formation plate 47 is fixed in such a manner as to be fitted between the downward wall 40*b* and the upright wall 40*a* (on the side where the opening 45 is present) of the top wall member 40. In this fixed state, the side surface on the one side of the downward wall 40*b* (the surface beside the opening 45) and the side wall surface 47*a* of the liquid flow path formation member 47 are in intimate contact, and the side wall surface 47*e* of the liquid flow path formation plate 47 is brought into intimate contact with the inner peripheral surface of the upright wall 40*a*, whereby the liquid flow path formation plate 47 is held stably.

Moreover, the lower surface of the top wall plate 40 and the upper surface of the liquid flow path formation plate 47 are kept in intimate contact. Hence, the part corresponding to the groove 47*d* defines the liquid flow path 33, and one end of the liquid flow path 33 communicates with the opening formed by the cutout 47*b*, while the other end of the liquid flow path 33 communicates with the opening 45.

The top wall plate 40 into which the liquid flow path formation plate 47 is fitted and fixed there as above is fitted into the internal space of the cylindrical side wall 11 of the cap body 1, and the partition plate 37 is fitted below the top wall plate 40. In this manner, the foaming box 5 is formed within the cylindrical side wall 7. Once the foaming box 5 is thus formed, the air-liquid mixture flow path 35 resulting from the merging of the air passage 31 and the liquid flow path 33 is formed between the upper surface of the foaming box 5 (top wall plate 40) and the lower surface of the ceiling wall 13.

The forgoing shows an example of the assembly of the foaming box 5, and the foaming box 5 may be formed in any manner, as long as the air passage 31, the liquid flow path 33, and the air-liquid mixture flow path 35 are formed.

Figure 6:
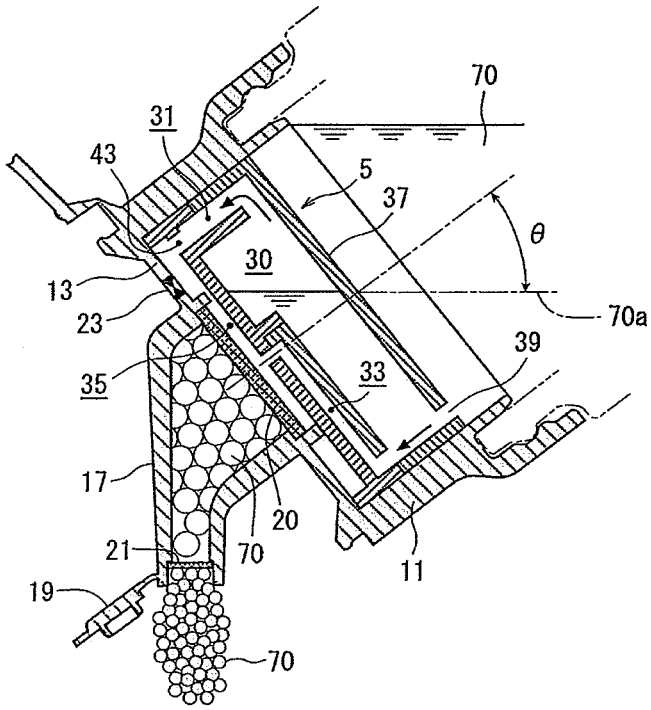
FIG. 6 is a view showing the state of the foam dispensing cap in FIG. 1 when a content liquid in a container is withdrawn using the cap.

FIG. 6 showing a state where the content liquid 70 within the container 60 is withdrawn will be referred to along with FIG. 1. In withdrawing the content liquid 70, the container is tilted by a suitable angle θ so that the leading end of the aforementioned ejection pipe 17 faces downward, with the inner lid 19 being opened, and the barrel of the container is squeezed. At this time, the content liquid in the container is taken into the box 5 through the liquid entry opening 39, passed along the air chamber 30, and flowed into the liquid flow path 33. Via the liquid flow path 33, the content liquid is flowed into the air-liquid mixture flow path 35. At the same time, the content liquid is admitted into the air chamber 30.

That is, under the liquid pressure of the container content liquid 70 which has entered the air chamber 30 (i.e., because of a rise in the liquid surface 70*a*), air inside the air chamber 30 does not flow into the container, but passes through the air passage 31 and flows into the air-liquid mixture flow path 35 through the air port 43.

In this manner, the air inside the air chamber 30 and the content liquid 70 from the container merge in the air-liquid mixture flow path 35 to be mixed thereby. The container content liquid 70 containing air bubbles passes through the coarse mesh 20 to become bubbles, which are introduced into the ejection pipe 17. Then, these bubbles are further converted into fine bubbles by the fine mesh 21 at the leading end of the ejection pipe 17, and ejected as a foam.

After completion of withdrawal of the container content liquid 70, on the other hand, the barrel of the container 60 is restored to its original shape, so that the interior of the container is placed under a negative pressure. Under the action of the non-return valve 23 provided in the ceiling wall 13 of the cap body 1 and owing to the inflow of air from the ejection pipe 17, the air chamber 30 is again fed with air necessary for foaming, and the head space 60*a* in the container 60 also receives inflow of air, thus returning to the same state as the state prior to use.

In the foam dispensing cap 50 of the present invention, as described above, air within the head space 60*a* inside the container 60 is not used, but air within the air chamber 30 inside the foaming box 5 is used. In order to mix the container content liquid 70 with air, therefore, there is no need to insert a particular tube into the container 60. In this manner, the foam dispensing cap of the present invention can perform capping of the mouth 61 of the container 60 very easily.

Since air within the air chamber 30 does escape toward the head space 60*a* within the container 60, moreover, foaming can be carried out stably and persistently.

In the aforementioned foaming box 5, the liquid entry opening 39 provided in the partition plate 37 should be disposed so as to be located on a lower side of the tilted container 60 (namely, in a direction in which the leading end of the ejection pipe 17 is pointed) for prompt intake of the container content liquid 70 so that foam dispensing of the container content liquid 70 by a squeeze put on the container 60 in a tilted state. Furthermore, the air passage 31 should be disposed on an upper side of the tilted container 60 (namely, on the side opposite to the liquid entry opening 39). According to these dispositions, the positions of the air port 43 and the non-return valve 23, and further the positions of the air passage formation wall 41, the opening 45 for passage of the content liquid, and the position of the liquid flow path formation plate 47 are determined. In other words, these positions are determined by the direction in which the leading end of the ejection pipe 17 is oriented.

Moreover, the air-liquid mixture flow path 35 is formed between the lower surface of the ceiling wall 13 and the foaming box 5 (top wall plate 40) by forming the foaming box 5 inwardly of the cylindrical side wall 11. For this purpose, it is preferred that in the ceiling wall 13 of the cap body 1, a short-length leg 49 be formed in an annular shape at the circumferential edge of the opening connecting with the ejection pipe (i.e., the circumferential edge of the coarse mesh 20). Needless to say, in this leg 49, a cutout for inflow of air from the air passage 31 is formed on its side facing the air passage 31.

The foam dispensing cap 50 of the present invention described above is produced by injection-molding a resin into the cap body 1 provided with the outer lid 3 and the inner lid 19, mounting the coarse mesh 20 and the fine mesh 21 on the molding product, and then further mounting the foaming box 5.

Aside from the mounting of the foaming box 5 described earlier, the fitting and fixing of the liquid flow path formation plate 47 to the top wall plate 40, and the fitting and fixing of the top wall plate 40 and the partition plate 37 to the interior of the cylindrical side wall 11 can be performed by appropriately adopting locking by an engaging means, or means such as an adhesive or a heat seal.

In the above-mentioned example, the air-liquid mixture flow path 35 for the content liquid 70 and air is formed outside the foaming box 5. However, such a mixing chamber 35 may be formed inside the box 5. This mode is shown in FIG. 7.

Figure 7:
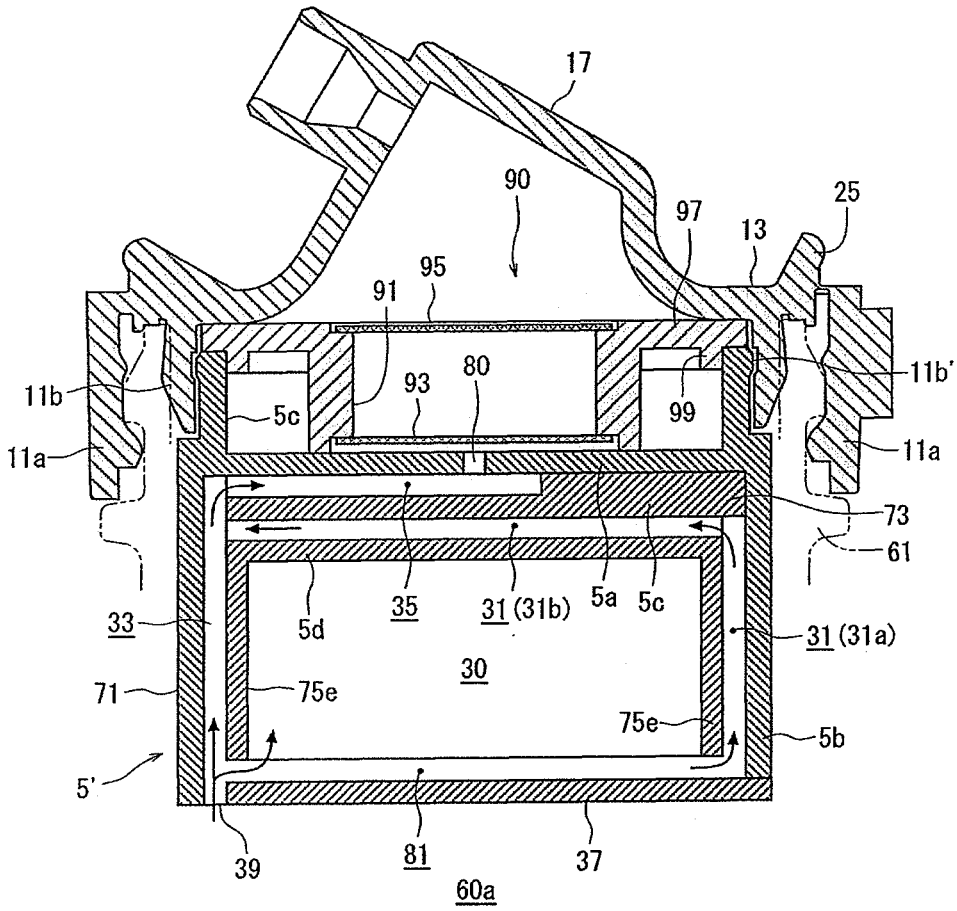
FIG. 7 is a side sectional view of the foam dispensing cap in a mode different from that of FIG. 1.

In a cap body 1 of a structure shown in FIG. 7 (an outer lid 3 and an inner lid 19 are omitted), a foaming box 5', which functions as a partition member for forming an air chamber, is locked to the inner surface side of an inner ring 11*b* serving as an internal wall for a cylindrical side wall 11. Further, a mesh box 90 is sandwiched between the foaming box 5' and a ceiling wall 13 of the cap body 1.

Inside the foaming box 5' in this mode, an air chamber 30, an air passage 31 and a liquid flow path 33 are formed. Further, in addition to a liquid entry opening 39 for a content liquid, there is formed an air-liquid mixture flow path 35 where the liquid flow path 33 and the air passage 31 merge for air-liquid mixing. In the foaming box 5', as will be understood from FIG. 7, the air chamber 30 and the head space 60*a* of the container 6 are separated by a partition plate 37, so that the entry of the content liquid into the air chamber 30 through the liquid entry opening 39 is considerably restricted.

Figure 8:
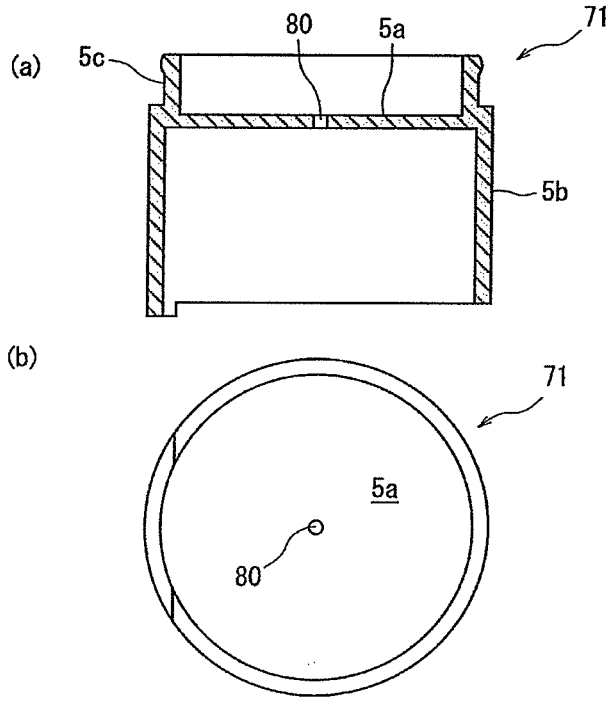
FIGS. 8(*a*), 8(*b*) are a side sectional view and a plan view, respectively, of an outer wall member for use in forming a foaming box shown in FIG. 7.
Figure 9:
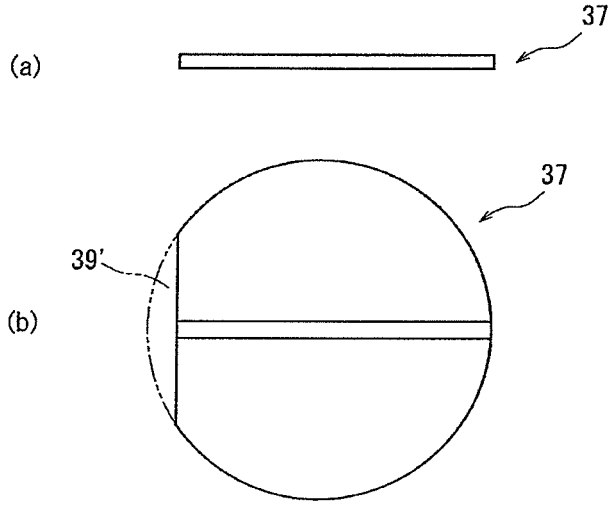
FIGS. 9(*a*), 9(*b*) are a side sectional view and a plan view, respectively, of a partition member for use in forming the foaming box shown in FIG. 7.
Figure 10:
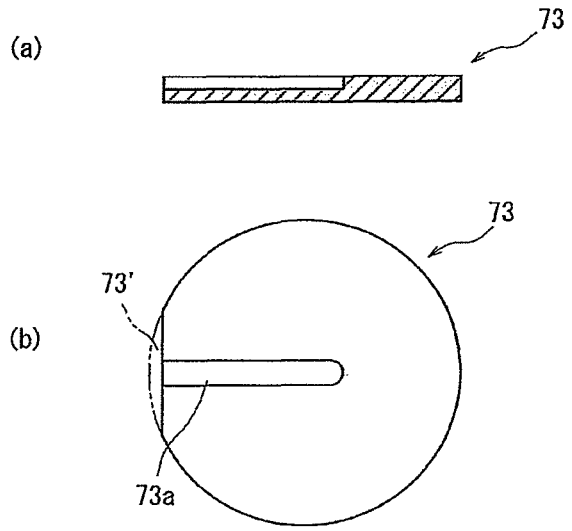
FIGS. 10(*a*), 10(*b*) are a side sectional view and a plan view, respectively, of an air-liquid mixture flow path formation member for use in forming the foaming box shown in FIG. 7.

Referring to FIGS. 8(*a*), 8(*b*) to 11(*a*), 11(*b*), which show various panels for forming the foaming box 5', along with FIG. 7, the foaming box 5' having the above structure is assembled from an outer wall member 71 (FIGS. 8(*a*), 8(*b*)), the partition plate 37 (partition wall) (FIGS. 9(*a*), 9(*b*)), an air-liquid mixture path formation member 73 (FIGS. 10(*a*), 10(*b*)), and an air chamber formation member 75.

That is, the outer wall member 71 is composed of a circular top panel portion 5*a*, and a cylindrical wall 5*b* extending downward from the circumferential edge of the top panel portion 5*a*, and an engaging annular projection 5*c* extending upward is formed in an upper surface peripheral edge part of the top panel portion 5*a* (see FIGS. 8(*a*), 8(*b*)). An outwardly projecting protrusion is formed in an upper end outer surface portion of the engaging annular projection 5*c*. This protrusion engages a concavity 11*b* formed in the inner peripheral surface of the inner ring 11*b* of the cap body 1, whereby the foaming box 5' is stably held inside the cylindrical side wall 11 of the cap body 1.

At the center of the top panel portion 5*a* mentioned above, an opening 80 is formed for passage of the air-liquid mixture from the air-liquid mixture flow path 35.

To the lower end of the cylindrical wall 5*b* of the above outer wall member 71, the partition plate 37 of the shape shown in FIGS. 9(*a*), 9(*b*) is fixed. In the partition plate 37, a cutout 39' is formed such that the liquid entry opening 39 is formed. In order to fix such a partition plate 37 smoothly and form the liquid entry opening 39 free of a step by use of the cutout 39', a part of the cylindrical wall 5*b* where the partition plate 37 is to be bound has a length shortened by the thickness of the partition plate 37 (see FIG. 8(*a*)).

As will be understood from FIG. 7, the air-liquid mixture path formation member 73 and the air chamber formation member 75 are built into a box-shaped space formed by the outer wall member 71 and the partition plate 37. Because of this configuration, the air chamber 30, the air passage 31, the liquid flow path 33, and the air-liquid mixture flow path 35, where the air passage 31 and the liquid flow path 33 merge, are formed within the box 5'.

The air-liquid mixture path formation member 73 is bonded and fixed to the lower surface of the outer wall member 71 and, as shown in FIGS. 10(*a*), 10(*b*), has a circular shape similar to the lower inner surface of the top panel portion 5*a*. Besides, at a position thereof corresponding to the liquid entry opening 39, a cutout 73' is formed so that the liquid flow path 33 connecting with the liquid entry opening 39 is formed.

In this member 73, moreover, a groove 73*a* corresponding to the air-liquid mixture flow path 35 is formed, and such a groove 73*a* extends so as to include a central part corresponding to the opening 80 of the top panel portion 5*a* of the outer wall member 71.

Figure 11:
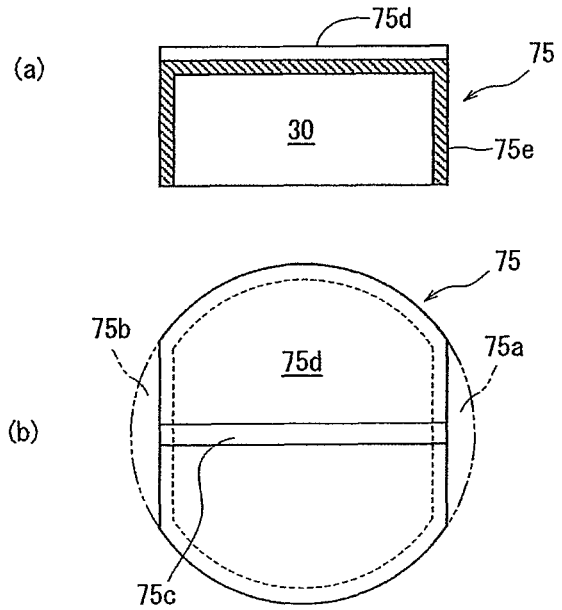
FIGS. 11(*a*), 11(*b*) are a side sectional view and a plan view, respectively, of an air chamber formation member for use in forming the foaming box shown in FIG. 7.

The air chamber formation panel 75 is fixed to the lower side of the above air-liquid mixture path formation member 73 and, as understood from FIGS. 11(*a*), 11(*b*), is composed of a top panel portion 75*d* and a cylindrical wall 75*e* extending downward from the circumferential edge thereof.

The top panel portion 75*d* is in a circular shape corresponding to the top panel of the outer wall member 71, but has cutouts 75*a*, 75*b* formed therein so as to oppose each other. That is, as understood from FIG. 7, the cutout 75*a* corresponds to the air passage 31*a* extending vertically, while the cutout 75*b* corresponds to the liquid flow path 33.

In a central part of the top panel portion 75*d*, a groove 75*c* extends so as to link the opposing cutouts 75*a* and 75*b* together. That is, this groove 75*c* corresponds to a horizontally extending air passage 31*b* which communicates with the vertically extending air passage 31*a* and merges with the liquid flow path 33.

The space surrounded with the air chamber formation member 75 of the above-mentioned shape, namely, the space surrounded with the top panel portion 75*d* and the cylindrical wall 75*e*, defines the air chamber 30.

As will be understood from the above explanations, the aforementioned foaming box 5' is assembled by fixing the air-liquid mixture path formation panel 73 inside the outer wall member 71, then building the air chamber formation panel 75 inside for fixation, and finally fixing the partition plate 37. At the time of such assembly, a heat seal, an adhesive or the like can be used, as appropriate, as for the aforementioned foaming box 5 of FIG. 2.

The assembled foaming box 5' is stably held in the cap body 1 by engaging the engaging annular projection 5*c* formed in the outer wall member 71 with the inner ring 11*b* of the cap body 1.

In the above foaming box 5', a gap 81 is formed between the cylindrical wall 75*e* of the air chamber formation member 75 and the partition plate 37. Through this gap 81, air in the air chamber 30 flows into the air passage 31, and the content liquid taken in through the liquid entry opening 39 is partly admitted into the air chamber 30.

In the cap having such a foaming box 5' built in, a lower part of the air chamber 30 is separated from the head space 60*a* within the container by the partition plate 37, so that during withdrawal of the container content liquid, air inside the air chamber 30 does not escape toward the head space 60*a*.

Furthermore, the liquid flow path 33 is divided from the air chamber 30 by the cylindrical wall 75*e* (the part corresponding to the cutout 75*a*) of the air chamber formation member 75, and control is exercised such that the content liquid does not enter the air chamber 30 at a stroke. In these respects, the mode in this configuration is greatly different from that in FIG. 1.

As will be understood from the above-described structure, even in the foam dispensing cap 50 equipped with such a foaming box 5', the container is tilted by a suitable angle θ, and the barrel of the container is squeezed. At this time, the content liquid in the container is taken into the box 5' through the liquid entry opening 39, and sent into the liquid flow path 33 and the air chamber 30. Also, under the liquid pressure of the content liquid entering the air chamber 30, air inside the air chamber 30 flows into the air passage 31, flows from the air chamber 31 into the air-liquid mixture flow path 35 where the air passage 31 merges into the liquid flow path 33. In the air-liquid mixture flow path 35, the container content liquid mixed with air flows in a turbulent state, thus generating air bubbles.

The opening 80 communicating with the interior of the mesh box 90 is formed in the top panel 5*a* serving as the upper wall of the air-liquid mixture flow path 35. Thus, the container content liquid bubbling upon mixing with air is introduced into the mesh box 90 through the opening 80.

The mesh box 90 is structured to have a coarse mesh 93 provided in a lower part of a hollow tubular body 91, and a fine mesh 95 provided in an upper part of the hollow tubular body 91. A horizontal flange 97 extends outwardly from the upper end of the hollow tubular body 91, and the horizontal flange 97 is held between the upper end of the engagement projection 5*c* provided on the top panel 5*a* of the foaming box 5' and the lower surface of the ceiling wall 13 of the cap body 1.

A projection 99 of a short length is formed annularly on the lower surface of the horizontal flange 97, and the outer surface of the projection 99 makes intimate contact with the inner surface of an upper part of the engagement projection 5*c*, whereby the mesh box 90 is firmly held.

The bubbling content liquid which has entered the mesh box 90 through the opening 80 passes through the coarse mesh 93 and the fine mesh 95 via the space between the top panel 5*a* and the coarse mesh 93, and flows into the ejection pipe 17. The content liquid which has turned into fine bubbles is ejected from the leading end of the ejection pipe 17.

With the foam dispensing cap provided with the foaming box 5', the content liquid taken in through the liquid entry opening 39 is inhibited from entering the air chamber 30 at a stroke. That is, if the content liquid enters the air chamber 30 at a stroke, air within the air chamber 30 will also be pushed out into the air passage 31 at a stroke. As a result, when the content liquid reaches the confluence of the liquid flow path 33 and the air passage 31, a considerable amount of air may be released, and the amount of air contributing to foaming may be decreased. In the present mode, however, entry of the content liquid into the air chamber 30 is somewhat restricted, so that a decrease in the amount of air contributing to foaming can be effectively prevented. Hence, almost all of air within the air chamber 30 is used for foaming. The present mode is thus very advantageous for performing the foam dispensing action persistently.

In the example of FIGS. 3(*a*), 3(*b*), a non-return valve for taking in air is not provided. In the present mode as well, however, the same non-return valve 23 as that in FIG. 1 can be provided. At the leading end of the ejection pipe 17, a mesh can be provided further.

The foam dispensing cap provided with the above-mentioned foaming box 5' is prepared by mounting the foaming box 5', which has been formed by joining of various members, to the cap body 1, which has been formed by injection molding, in such a manner as to sandwich the mesh box 90 assembled separately between the cap body 1 and the foaming box 5'. In this state, the foam dispensing cap is mounted on the mouth 61 of the squeeze container 60 charged with the content liquid.

In the present mode, moreover, the mesh box 90 is provided as a member separate from the cap body 1, but can also be provided integrally with the cap body 1.

The above foam dispensing caps of FIGS. 1 and 7 have structures in which the cap body 1 provided with the foaming box 5 or 5' having the air chamber 30 partitioned from the head space 60*a* of the container is mounted on the mouth 61 of the squeeze container 60. However, instead of forming the air chamber 30 from the foaming box 5 or 5', it is possible to form the air chamber 30 by combining an inner lid with the cap body 1. That is, in this structure, the inner lid functions as a partition member for forming the air chamber.

Figure 12:
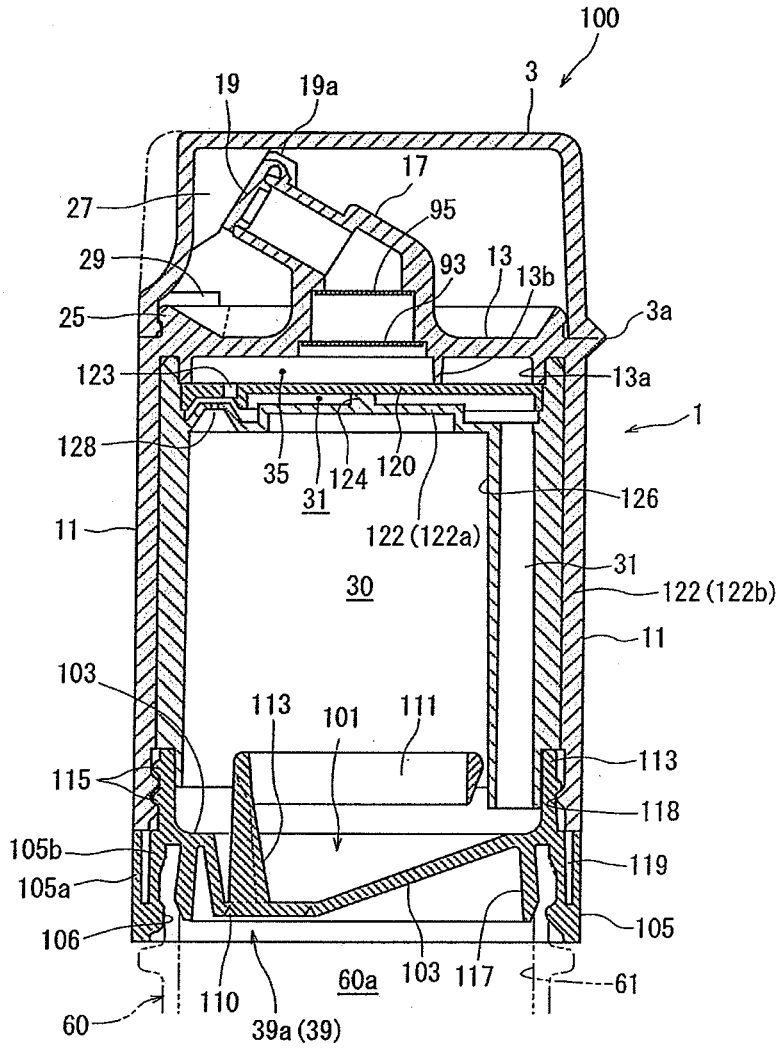
FIG. 12 is a side sectional view of the foam dispensing cap in still another mode of the present invention.

The structure of the foam dispensing cap described here is shown in FIG. 12.

In FIG. 12, a foam dispensing cap indicated entirely at 100 is composed of a cap body indicated entirely at 1, and an inner lid indicated entirely at 101.

The cap body 1 has many parts structurally in common with those in the cap bodies 1 shown in FIGS. 1 and 7. Thus, the common parts are shown by the same numerals.

In the illustrated mode, the inner lid 101 is mounted on the mouth 61 of the squeeze container 60.

Such an inner lid 101 is composed of a partition wall 103, and an annular side wall 105 extending downward from its peripheral edge portion.

The partition wall 103 forming the upper surface of the inner lid 101 divides the head space 60*a* within the container 60 from the air chamber 30, as does the partition wall 37*a* provided in the foaming boxes 5, 5' of the caps 50 in FIGS. 1 and 7.

A central part of the partition wall 103 is in a concave shape, and endless scores 110 are formed within the concavity. A region surrounded with the scores 110 becomes a liquid entry opening-scheduled portion 39*a* for forming a liquid entry opening 39.

A strut 113 having a pull ring 111 at its upper end is provided on the upper surface of the liquid entry opening-scheduled portion 39*a*. By pulling up the pull ring 111, the scores 110 are broken to form the aforementioned liquid entry opening 39. That is, the liquid entry opening-scheduled portion 39*a* is converted into the liquid entry opening 39.

A cylindrical engagement projection 113 extending upward is provided in a peripheral edge portion of the partition wall 103. On the outer surface of the engagement projection 113, a thread 115 is formed for mounting thereon the cap body 1.

On the lower surface of the partition wall 103, an inner ring 117 is provided which extends downward at a distance from the annular side wall 105. The mouth 61 of the squeeze container 60 is fitted into the space between the inner ring 117 and the annular side wall 105, whereby the inner lid 101 is fixed to the mouth 61.

With the inner lid 101 being fixed to the mouth 61, the outer surface of the inner ring 117 is in intimate contact with the inner surface of the mouth 61, thus ensuring satisfactory sealing properties.

An engagement protrusion 106 is formed on the inner surface at the lower end of the annular side wall 105. Thus, the inner lid 101 fitted with the mouth 61 is firmly fixed to the mouth 61.

An upper part of the annular side wall 105 has a slit 119 formed in its entire or partial periphery, whereby the annular side wall 105 is divided into an outer side wall 105*a* and an inner side wall 105*b*. Because of this double-walled structure, it becomes possible to detach the inner lid 101 from the mouth 61 easily, without using a special tool, for example, by peeling off the outer side wall 105*b*. It becomes also possible to carry out the mounting (application) of the inner lid 101 easily onto the mouth 61.

The cap body 1 is composed of a cylindrical side wall portion 11, and a ceiling wall 13 formed to close an upper end opening of the cylindrical side wall portion 11, as in the aforementioned foam dispensing caps 50 shown in FIGS. 1 and 7.

A thread 118 is provided on the inner surface of a lower part of the cylindrical side wall portion 11. Upon threaded engagement between the thread 118 and the thread 115 on the outer surface of the engagement projection 113 of the inner lid 101, the cap body 1 is fixed to the inner lid 101.

An ejection pipe 17 is erected on the upper surface of the ceiling wall 13, and the content liquid inside the container 60 is passed through the ejection pipe 17 and ejected from its leading end in a foamy state.

The ejection pipe 17 also has an upper part inclining and, to its leading end an inner lid 19 is hinge-connected at a junction 19*a*.

At the base of the interior of the ejection pipe 17, a coarse mesh 93 as used in the cap of FIG. 7 is provided, while a fine mesh 95 is provided upwardly of and at a distance from the coarse mesh 93.

On the lower surface of the ceiling wall 13, an annular small projection 13*a* for stably fixing various members to be described later and for securing a space serving as a flow path is formed near the circumferential edge of the ceiling wall 13. Further, a liquid flow regulating projection 13*b* for regulating the flow of the liquid is formed. Their functions will be described later.

An outer lid 3 is provided on the ceiling wall 13 of the cap body 1 so as to cover the ejection pipe 17, as in the foam dispensing caps 50 of FIGS. 1 and 7. For example, the outer lid 3 is hinge-connected to the ceiling wall 13 (a hinge connection is indicated at 3*a*), and a peripheral edge portion of the ceiling wall 13 is provided with an engagement projection 25 for holding the closed outer lid 3 stably.

The internal structure of the outer lid 3 described above is substantially the same as those shown in FIGS. 1 and 7. Inside the outer lid 3, for example, there are provided a rib 27 for holding a hinge lid 19, which is provided at the leading end of the ejection pipe 17, in a closed state, and a protruding piece 29 for opening and closing the hinge lid 19 interlockingly with the opening and closing of the outer lid 3.

That is, the outer lid 3 is opened and closed when pivoted about the hinge connection 3*a* as a fulcrum. When the outer lid 3 is pivoted for closure, the protruding piece 29 and the rib 27 touch the hinge lid 19 during this pivoting and, while they are pushing the hinge lid 19, the outer lid 3 turns in a closing direction. When, as a result, the outer lid 3 is closed, the hinge lid 19 is also closed, whereby the leading end of the ejection pipe 17 is sealed.

Moreover, the closed outer lid 3 has the inner surface at the lower end of its side wall brought into engagement with the engagement projection 25 formed in the peripheral edge portion of the ceiling wall, with the result that the closed state of the outer lid 3 is held stably. Simultaneously, the rib 27 provided in the outer lid 3 is firmly pressed against the inner lid 19, so that the closed state of the inner lid 19 is also held stably.

When the closed outer lid 3 is pivoted to be opened, the protruding piece 29 provided in the outer lid 3 contacts a flange portion of the inner lid 19 to push the inner lid 19 upward in accordance with the pivoting of the outer lid 3. As a result, simultaneously with the unclosing of the outer lid 3, the inner lid 19 is also unclosed, whereupon the leading end of the ejection pipe 17 is opened to become capable of ejecting the content liquid.

In the cap body 1 mounted on the inner lid 101 in the above manner, a mixture flow path formation panel 120 and an air chamber formation panel 122 are inserted in and fixed to the inside of the cylindrical side wall 11.

The mixture flow path formation member 120 has the shape of a substantially flat disk, and is disposed on a lower side of the ceiling wall 13 (above the air chamber formation member 122). In the vicinity of the end of the mixture flow path formation panel 120, an opening 123 is formed.

That is, the annular small projection 13*a* and the liquid flow regulating projection 13*b* provided on the lower side of the ceiling wall 13 make contact with the upper surface of the mixture flow path formation panel 120. Because of this configuration, an air-liquid mixture flow path 35 is formed between the upper surface of the mixture flow path formation panel 120 and the lower surface of the ceiling wall 13. The liquid which has flowed into the air-liquid mixture flow path 35 through the opening 123 is guided into the ejection pipe 17 by the liquid flow regulating projection 13*b*. After completion of ejection of the content liquid, the liquid dripping off from the ejection pipe 17 is promptly guided into the opening 123 by the liquid flow regulating projection 13*b*.

The air chamber formation member 122 is formed from a top panel substrate 122*a*, and a cylindrical wall 122*b* formed on its circumferential edge.

The cylindrical wall 122*b* has an outer diameter corresponding to the inner diameter of the cylindrical side wall 11 of the cap body 1, and is fitted into the interior of the cylindrical side wall 11. An upper part of the cylindrical wall 122*b* protrudes beyond the upper surface of the top panel substrate 122*a*, and is fitted into the space between the annular small projection 13*a* and the cylindrical side wall 11.

As will be understood from FIG. 12, when the cap body 1 is mounted on the inner lid 101, the air chamber formation member 122 faces the partition wall 103 which is the upper surface of the inner lid 101. Between the air chamber formation member 122 and the partition wall 103, an air chamber 30 is formed which is separated from the head space 60*a* within the container 60.

A flat small projection 124 is formed on the upper surface of the top panel substrate 122*a*. This small projection may be formed on the lower surface of the mixture flow path formation member 120. That is, the provision of such a small projection 124 enables a certain clearance to be secured between the lower surface of the mixture flow path formation member 120 and the upper surface of the top panel substrate 122*a*, and thus an air passage 31 can be formed between them.

In a peripheral edge portion of the top panel substrate 122*a*, a tubular downward wall 126 and a small hole 128 are formed. The tubular downward wall 126 is formed on a side diametrically opposite to the discharge direction of the ejection pipe 17.

The tubular downward wall 126 defines the air passage 31 inside. That is, as will be understood from FIG. 12, the interior of the tubular downward wall 126 communicates with the air chamber 30, and also communicates with the space between the lower surface of the mixture flow path formation member 120 and the upper surface of the top panel substrate 122*a*. Thus, the air passage 31 communicating with the interior of the air chamber 30 and also communicating with the air-liquid mixture flow path 35 via the aforementioned opening 123 is formed.

Figure 13:
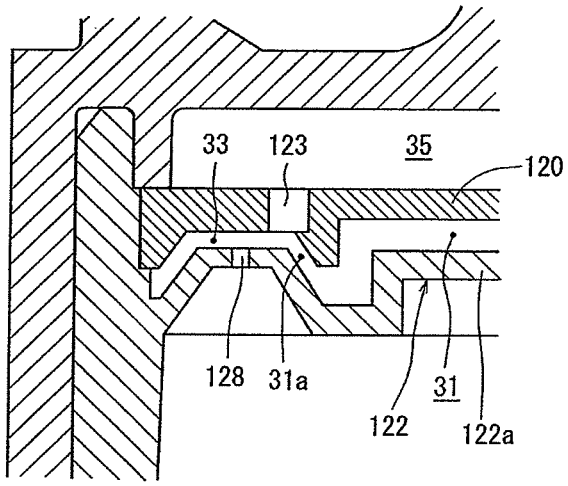
FIG. 13 is a view showing, on an enlarged scale, the position of merging of an air passage and a liquid flow path in the foam dispensing cap of FIG. 12.

Further referring to the enlarged view of FIG. 13, the above small hole 128 is located on a side diametrically opposite to the tubular downward wall 126. This small hole 128 serves as an outlet for the content liquid which has passed through the liquid entry opening 39 formed by tearing the scores 110 of the inner lid 101, and has entered the interior of the air chamber 30. That is, a liquid flow path 33 starting at the small hole 128 is formed on the upper surface of the top panel substrate 122*a*.

In the present invention, the small hole 128 of the above air chamber formation member 122 and the opening 123 of the mixture flow path formation member 120 are preferably formed at positions slightly displaced from each other. As shown in FIG. 13, for example, it is preferred that the small hole 128 be positioned outwardly, while the opening 123 be positioned slightly inwardly. The liquid flow path 33 exiting from the small hole 128 immediately merges with the air passage 31 to become the air-liquid mixture flow path 35. This site of merging is desirably a constricted narrow space. Further, it is recommendable that a peripheral edge portion of the top panel substrate 122*a*, where the small hole 128 is formed, be formed to protrude in the shape of a truncated cone, and the lower surface of the mixture flow path formation member 120 at the site of location of the opening 123 be rendered a tapered surface along the truncated cone shape to form the lower flow path (air passage 31) into a tapered path 31*a*. By so doing, air having flowed through the air passage 31 and the content liquid having flowed out of the small hole 128 are effectively mixed and stirred. Thus, air bubbles can become easily producible, and the entry of the liquid flowing down through the opening 123 into the air passage 31 can be suppressed to prevent clogging of the air passage 31 with the content liquid effectively.

The insertion and fixation of the mixture flow path formation member 120 and the air chamber formation member 122 into the cylindrical side wall 11 are performed, for example, by fitting the air chamber formation member 122 into the cylindrical side wall 11, with the mixture flow path formation member 120 being borne on the member 122. In performing the above insertion and fixation, it goes without saying that locking by an engaging means, heat sealing, or adhesive fixation using an adhesive or the like can be used appropriately.

With the above-described foam dispensing cap 100 of FIG. 12, the cap body 1 is turned to be detached from the inner lid 101. Then, the pull ring 111 of the inner lid 101 is pulled to rupture the scores 110, thereby forming the liquid entry opening 39. Then, the cap body 1 is mounted on the inner lid 101, whereupon the content liquid can be ejected in a foamy state by the same procedure as for the caps of FIGS. 1 and 7.

That is, the outer lid 3 and the inner lid 19 are opened and, in this state, the container is tilted by a suitable angle θ so that the leading end of the ejection pipe 17 faces downward, and the barrel of the container is squeezed. As a result, the content liquid in the container passes through the inside of the air chamber 30 from the liquid entry opening 39, and flows into the liquid flow path 33 via the small hole 128. On the other hand, under the liquid pressure of the container content liquid 70 which has entered the air chamber 30 (i.e., because of a rise in the liquid surface 70*a*), air inside the air chamber 30 does not flow into the container, but passes through the air passage 31 and flows into the confluence with the liquid flow path 33.

In this manner, the air inside the air chamber 30 and the content liquid from the container merge in the air-liquid mixture flow path 35 to be mixed thereby. Then, the container content liquid containing air bubbles passes through the coarse mesh 93 and the fine mesh 95 to become bubbles, which are ejected from the ejection pipe 17.

After completion of withdrawal of the container content liquid, the barrel of the container 60 is restored to its original shape, so that the interior of the container is placed under a negative pressure. Owing to the inflow of air from the ejection pipe 17, therefore, the air chamber 30 is again fed with air necessary for foam dispensing, and the head space 60*a* in the container 60 also receives inflow of air, thus returning to the same state as the state prior to use.

In the present invention, as described above, there is no need to use a tube for foam dispensing, and no operation is performed for inserting a tube into the container, in any of the modes shown in FIGS. 1, 7 and 12. Thus, the capping work can be done efficiently and swiftly, and productivity is very high.

The foam dispensing cap of the present invention is utilized as a cap for squeeze containers which accommodate foods, beverages, cleaning agents, cosmetics, etc. required to be supplied in small amounts at a time, or which are charged with fluid contents requiring foam dispensing.

EXPLANATIONS OF LETTERS OR NUMERALS

1: Cap body
5: Foaming box
11: Cylindrical side wall
13: Ceiling wall
17: Ejection pipe
30: Air chamber
31: Air passage
33: Liquid flow path
35: Air-liquid mixture flow path
37: Partition plate
37*a*: Partition wall
60: Squeeze container
60*a*: Head space
61: Mouth of container
70: Content liquid in container

The invention claimed is:

1. A foam dispensing cap to be mounted on a mouth of a squeeze container, comprising:

a cap body composed of a ceiling wall and a cylindrical side wall extending downwardly from a circumferential edge of the ceiling wall; and a partition member having an opening serving as a passage for a content liquid charged in the squeeze container, the partition member being mounted in the cap body, wherein an ejection pipe communicating with a space below the ceiling wall and adapted to eject the content liquid in the container is erected on an upper surface of the ceiling wall;

an air chamber is formed in the space below the ceiling wall, the air chamber being partitioned off from a head space of the squeeze container by the partition member when the foam dispensing cap is mounted on the mouth of the squeeze container;

in the air chamber, an air passage for flowing air within the air chamber and a liquid flow path for flowing the content liquid, which has passed through the opening and entered the air chamber, to the ejection pipe communicate with each other, the air passage and the liquid flow path are formed to merge at a confluence, and a region ranging from the confluence to the ejection pipe defines an air-liquid mixture flow path; and when the squeeze container is tilted and squeezed, the content liquid passes through the opening provided in the partition member, enters the air chamber, and flows into the liquid flow path and, simultaneously, air within the air chamber flows into the air passage under a liquid pressure due to entry of the content liquid into the air chamber, whereupon the content liquid flowing into the liquid flow path and the air flowing into the air passage mingle with each other at the confluence, and the content liquid containing air bubbles passes through the ejection pipe and is ejected in a foamy state from a leading end of the ejection pipe.

2. The foam dispensing cap according to claim 1, wherein at least one mesh member for adjusting an air bubble diameter is provided between the air-liquid mixture flow path and the leading end of the ejection pipe.

3. The foam dispensing cap according to claim 1, wherein a portion to be engaged with or fitted to the mouth of the squeeze container is formed in the cylindrical side wall, and a foaming box is fixed as the partition member to an interior of the cylindrical side wall, the foaming box having a partition wall provided with the opening, and an upright wall extending upward from an outer peripheral portion of the partition wall, and the foaming box being assembled such that the air chamber, the air passage and the liquid flow path are formed.

4. The foam dispensing cap according to claim 3, wherein upon fixing of the foaming box to the interior of the cylindrical side wall, the air-liquid mixture flow path communicating with an interior of the ejection pipe is formed between a lower surface of the ceiling wall and an upper surface of a box.

5. The foam dispensing cap according to claim 3, wherein the air-liquid mixture flow path is formed inside the foaming box.

6. The foam dispensing cap according to claim 1, wherein an inner lid having as an upper surface thereof a partition wall provided with the opening and being adapted to be fixed to the mouth of the squeeze container functions as the partition member;

the cylindrical side wall is provided detachably on the inner lid;

an opening-scheduled portion, which forms the opening upon rupture due to pulling of an unsealing ring, is formed in the partition wall of the inner lid; and the air chamber, the air passage, the liquid flow path, and the air-liquid mixture flow path are formed between the partition wall, which is the upper surface of the inner lid, and the ceiling wall.

* * * * *